US006311379B1

(12) United States Patent
Torre et al.

(10) Patent No.: US 6,311,379 B1
(45) Date of Patent: Nov. 6, 2001

(54) FOLDING MACHINE

(75) Inventors: Juan Torre, Kindhausen; Anton Loser, Wattwil, both of (CH)

(73) Assignee: Tormec AG, Dietikon (CH)

( * ) Notice: Subject to any disclaimer, the term of this patent is extended or adjusted under 35 U.S.C. 154(b) by 0 days.

(21) Appl. No.: 09/445,192

(22) PCT Filed: May 11, 1998

(86) PCT No.: PCT/CH98/00192

§ 371 Date: Feb. 29, 2000

§ 102(e) Date: Feb. 29, 2000

(87) PCT Pub. No.: WO98/55245

PCT Pub. Date: Dec. 10, 1998

(30) Foreign Application Priority Data

Jun. 3, 1997 (CH) ..... 1326/97

(51) Int. Cl.[7] ..... B23P 11/00
(52) U.S. Cl. ..... 29/243.58; 29/243.5; 29/243.518
(58) Field of Search ..... 29/243.58, 243.5, 29/243.518

(56) References Cited

U.S. PATENT DOCUMENTS

| | | | | |
|---|---|---|---|---|
| 3,067,709 | * | 12/1962 | Conti et al. | 29/243.58 |
| 3,914,971 | * | 10/1975 | Colbath | 72/178 |
| 4,006,520 | * | 2/1977 | Wachter | 29/243.52 |
| 4,538,334 | * | 9/1985 | Binggeli | 29/243.5 |
| 5,228,190 | * | 7/1993 | Sawa | 29/243.57 |
| 5,604,966 | * | 2/1997 | Morello et al. | 29/243.58 |

FOREIGN PATENT DOCUMENTS

| | | |
|---|---|---|
| 2447037 | 1/1976 | (DE) . |
| 0104145 | 3/1984 | (EP) . |

* cited by examiner

*Primary Examiner*—Derris H. Banks
*Assistant Examiner*—Lee Wilson
(74) *Attorney, Agent, or Firm*—Martin A. Farber

(57) ABSTRACT

The invention relates to a folding machine for producing folded seam connections between partial surfaces (38*a*) consisting of flat material closed in a tubular form. The inventive folding machine comprises a machine stand (2*a*, 2*b*, 2*c*), a fixed wheel (3), a pressing wheel (4) which is able to move in relation to said fixed wheel (3), and a closing plate (3) which is displaceable in relation to said pressing wheel (4) and which is arranged on a first bearing part (14) in such a way that it can turn. The folding machine also comprises a guiding device (17, 18) by which means the first bearing part (14) swings forward between a final release position and a final pressing position. During the movement between these two final positions, the distance between the edge areas of the closing plate and the pressing wheel (4) which project against the fixed wheel changes, as does the orientation of the closing plate (5). The first bearing part is pulled back relatively slightly to change the pressing wheel, since the area with the closing plate swings up at the same time. There is no need to remove the first bearing part and its guiding device. Said guiding device (17, 18) comprises for example at least two guiding grooves (17) which are slanted in relation to each other. A bearing part, such as a bearing roll (18) is situated in each guiding groove (17), said bearing part being able to move along the groove.

24 Claims, 2 Drawing Sheets

FOLDING MACHINE

The invention relates to folding machines.

FIELD AND BACKGROUND OF THE INVENTION

When producing folded seam connections between partial surfaces of flat material closed in a tubular form or pipe segments, folding machines are used which comprise a machine stand, a fixed wheel, a pressing wheel which is able to displace in relation to the fixed wheel, and a closing disk which is displaceable in relation to the pressing wheel. In a first operation cycle, a flange-like outward extending brim or border is formed on each one of the pipe segments to be interconnected. To this end, matching folding wheels are used as a pressing wheel and a fixed wheel. In a second operation cycle, the pipe segments are joined to the two flange-like brims which are matching so as to achieve a folded seam connection. In particular, a single border is inserted into a double border, the double border being clamped together at individual locations. The, thus, assembled parts are put over the fixed wheel in such a manner that the joining region extends in its plane. For beading, the flange-like brim or the lower side of the double border engages the pressing wheel, and the closing disk is pressed or advanced step by step against a flange rim which projects somewhat in upward direction until the folded seam connection is completed. In this operation a substantially cylindrical disk is used as a fixed wheel, and a bearing disk as a pressing wheel. To rotate the pipe segments, either the fixed wheel and/or the pressing wheel may be driven. By a folding machine, lids or caps are attached to pipe segments in some cases.

From EP 104 145 a folding closure machine is known wherein a closing disk slide is supported by a rest so as to be parallel displaceable along a guide plate. The rest is mounted on a advance slide directly above the propping or pressing wheel. To exchange the pressing wheel or to use a folding wheel or a supporting disk in accordance with the operating cycle, the rest has to be detached, lifted off, put on again and fastened. This work is extremely troublesome, because the rest together with the closing disk slide are very heavy. Therefore, it is not efficient to use the machine alternately for both operation cycles mentioned above which, however, cannot be avoided with small series. Further disadvantages of the known approach consist in that the distance between the closing disk and the pressing wheel is not adjustable, and the pressing surface of the closing disk has always the same orientation, although the thickness of a folded seam connection and the orientation of the surface completely pressed by and facing the closing disk depend on the type of folded seam connection and on the flat material used. When using a closing disk which has always the same orientation, the difference in orientation of the surface to be pressed cannot be taken into account.

SUMMARY OF THE INVENTION

Therefore, it is an object of the invention to find a folding machine which is simple in construction, where the pressing wheel can be exchanged with a low labor consumption, and where the pressing surface of the closing disk is not oriented in a fixed manner.

Within the framework of the present invention, it has been recognized that a guiding arrangement for a first bearing part, on which the closing disk is rotatably supported, can also be formed at the side of the pressing wheel averted from the fixed wheel or behind the same. In this way, at least removal of the guiding arrangement or of a rest is no longer necessary. In order to avoid removal of the first bearing part, the guiding arrangement should be formed in such a manner that the first bearing part, displaced to a release stop, as well as the closing disk attached to it are sufficiently spaced from the pressing wheel so that the latter can unimpededly be exchanged. It has been found that, with only a single straight-line motion mechanism, the first bearing part has to be shifted rearwards very far, or, in the case of a guide which is rearwards and upwards inclined, the guiding arrangement has to be constructed undesirably high.

With the approach according to the invention, the first bearing part is guided by a guiding arrangement for achieving a pivoting advance between a final releasing position and a final pressing position. With the pivoting advance motion, thus achieved, the distance between the marginal regions of the closing disk which project towards the fixed wheel and of the pressing wheel as well as the orientation of the closing disk is varied between both final positions. By the pivoting reset and advance, the guiding arrangement solves both the problem of releasing the pressing wheel and the problem of the pressing surface orientation in the region of the final pressing position. When resetting, the closing disk is moved at the same time rearwards and away from the pressing wheel in upward direction. In this way, with a little shift of position, an extremely large free space can be created above the pressing wheel. When advancing in the region of the final pressing position, the orientation of the pressing surface of the closing disk changes within a small angular range which is preferably chosen in such a manner that the pressing surface can be oriented for the current folded seam connections with small advancing differences. In order to attain an optimum orientation facility over a larger angular range an adjusting device for adjusting the orientation of the closing disk relative to the guiding arrangement is provided according to a preferred embodiment. Choosing the adjustment of orientation involves in each case also the selection of a distance between the closing disk and the pressing wheel at the final pressing position.

BRIEF DESCRIPTION OF THE DRAWINGS

The folding machine according to the invention will be explained with reference to an embodiment shown in the drawings wherein.

DETAILED DESCRIPTION OF THE PREFERRED EMBODIMENT

Figure 1:
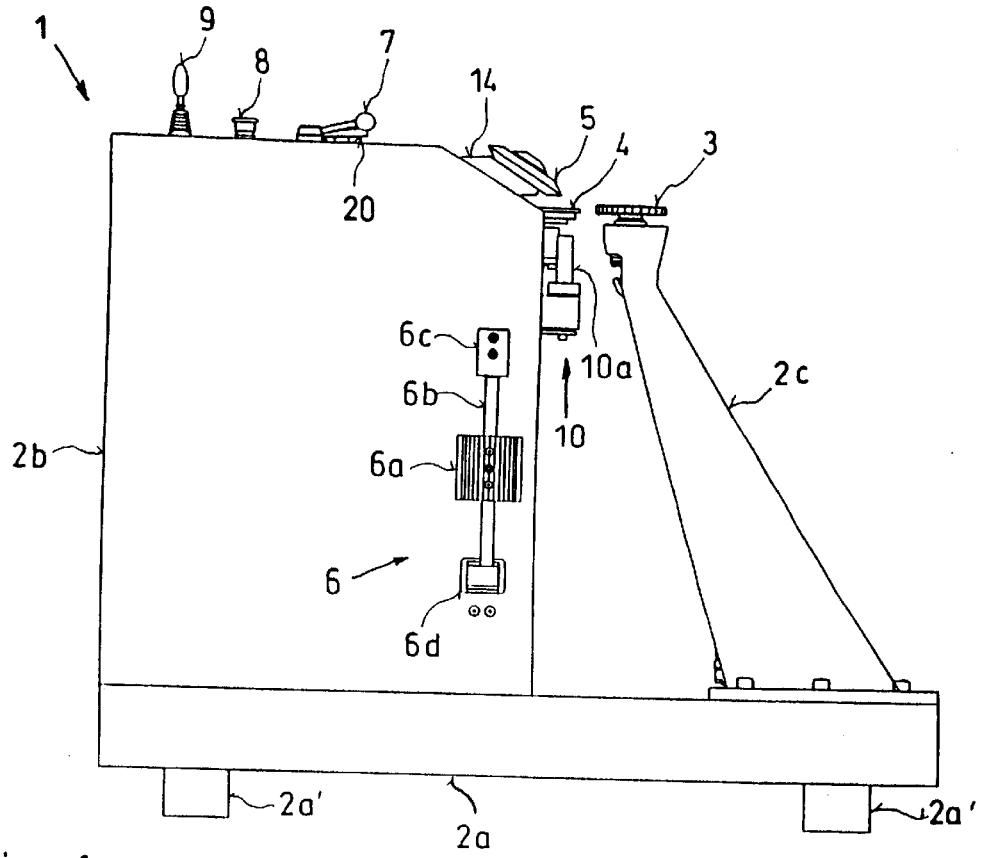
FIG. 1 is a lateral view of a folding machine.
Figure 2:
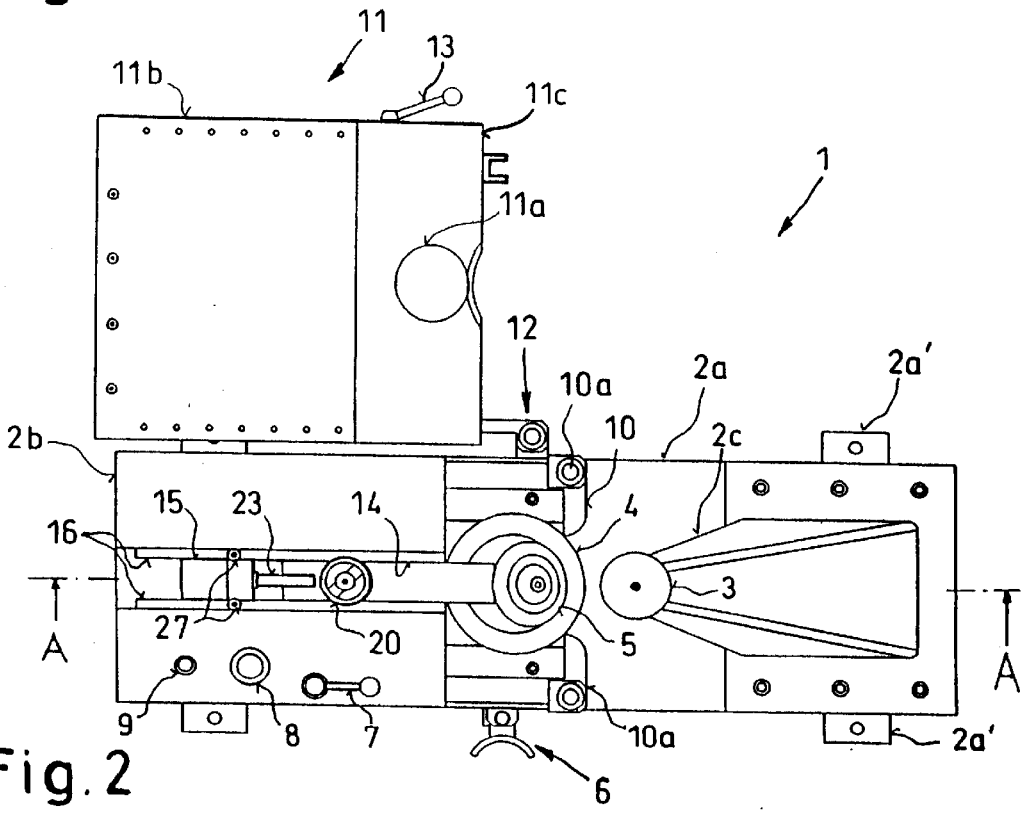
FIG. 2 is a plan view onto a folding machine according to FIG. 1.

FIGS. 1 and 2 show a folding machine 1 having a bottom part 2*a* and two stand parts 2*b* and 2*c* of which a first one 2*c* is slim and separated from the other one 2*b* so that pipe segments can be put over it. The machine frame can be fastened to the bottom by bottom fasteners 2*a*'. The upper end of the slim stand part 2*c* supports a fixed wheel 3 which is formed as a folding wheel when beading and as a guiding wheel when closing the folded seam connection. In the embodiment shown, the fixed wheel is only rotatable about a fixed axis. However, embodiments are also possible wherein the fixed wheel 3 is displaceable or, in some cases, tiltable. The broad stand part 2*b* supports a pressing wheel 4 and a closing disk 5.

When beading and closing the folded seam connection, the pressing wheel 4 is advanced and pressed toward the fixed wheel. In order to be able to adjust the advancing movement or the pressing force while at the same time having the hands left free for holding the pipe bend, a knee lifter 6 is laterally provided on the folding machine. The knee lifter comprises a rod 6*b* pivotably supported in a pivot bearing 6*c*, a knee shell 6*a* being mounted on it and adjustable in height. By moving a knee and the knee shell, a pivot excursion of the rod 6*b* is achieved which controls advance or reset of the pressing wheel by a valve actuation arrangement.

The pressing wheel 4 and/or the fixed wheel 3 may be driven by a prime mover, preferably a hydraulic motor, but in case two hydraulic motors are used, they may preferably be driven in series by a common pump, the driving speed being adjustable by a flow regulator. Actuation of the flow regulator, and thus the adjustment of the speed of rotation of either the pressing wheel and/or of the fixed wheel, is carried out bad means of a speed lever 7 at the top of the folding machine. An emergency stop 8 switches the pump off or on. In order to adjust the closing disk 5 relative to the pressing wheel 4, an actuation member may be controlled by a closing switch 9. A pipe holding device 10 is mounted on the machine frame in the region below the pressing wheel 4 at both of its sides by two pivot bearings 10*a* having vertical axes.

When beading, a support surface is needed in the region about the fixed wheel 3, the support surface being arranged at the lower edge of the fold producing portion of the pressing wheel 4 and the fixed wheel 3. According to FIG. 2, such a support surface is connected to the machine frame as a table surface 11 pivoting about a pivot bearing 12. For closing a folded seam connection, it is pivoted into the position shown. When beading, a recess 11*a* is situated around the fixed wheel 3. In order to be able to move the table surface 11 over the fixed wheel 3, it comprises a first table portion 11*b* and a second table portion 11*c*, the second table portion 11*c* and a portion of the edge of the recess 11*a* being allowed to be lifted over the fixed wheel 3. In the embodiment shown, the table portion 11*c* may be swung out along the joining line to the table portion 11*b* and may be fixed in any position desired by means of a fixing lever 13.

The closing wheel 5 is one-sided supported in a rotatable manner at the front end of a first bearing part 14. The first bearing part 14 is displaceable by a first actuation element 15. Both the first bearing part 14 and the first actuation element 15 are supported in two two-part guide blocks 16, arranged on either side, or in grooves of the same.

Figure 3:
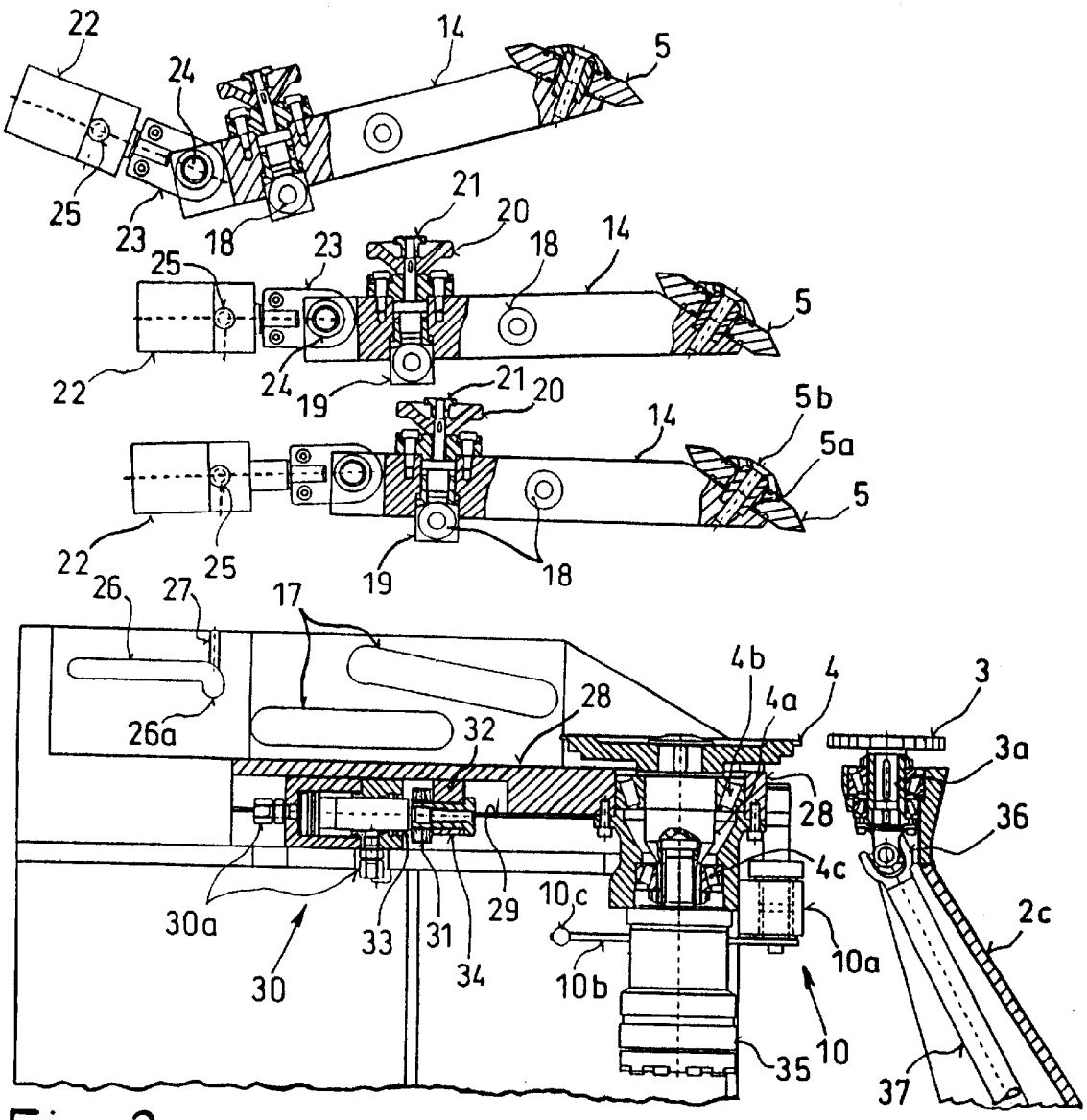
FIG. 3 is a vertical cross-section (according to A—A in FIG. 2) of the upper region of the folding machine showing above three pivot positions of a first bearing part.

FIG. 3 shows a two-part guide block 16 and above the first bearing part 14 and the first actuation element 15 in three different positions of advancing or resetting. This figure shows the operation of the guiding arrangement according to the invention for achieving a pivoting advance of the closing disk 5. The guiding arrangement comprises in each guide block 16 two guiding grooves 17 inclined to each other, and two support rolls 18 laterally protruding on both sides each from the first bearing part 14 and located each in a guiding groove 17 in working condition to be moveable along it. In transverse direction to the guiding grooves 17, the support rolls 18 are substantially free of any play. The guiding grooves of the two guide blocks 16 are formed as a pair of grooves which are mirror symmetrical with respect to a, preferably vertical, center plane. Correspondingly, the support rolls 18 rotatably supported by the first bearing part 14 are also arranged in a mirror symmetrical manner with respect to the center plane, i.e. each pair of them have a common axis which extends orthogonally to the axis of the first bearing part 14. It goes without saying that other support elements, such as support bolts, may be used instead of the support rolls.

In the embodiment shown, the lower guiding groove 17 extends substantially in horizontal direction, and an upper one guides towards the pressing wheel 4 downwards along a straight line. The guiding grooves 17 and the first bearing part 14 together with the support rolls 18 are constructed in such a manner that the front edge region of the closing disk 5 is situated at the front stop of the guiding arrangement, and in the final pressing position is above that edge region of the pressing wheel 4 which faces the fixed wheel 3. When moving rearwards and away from the fixed wheel 3, the front support rolls 18 move upwards in the inclined guiding groove 17, while the rear ones remain on the same level so that the first bearing part 14, when displaced rearwards, effects in addition a pivoting motion about the axis of the two rear support rolls. It has to be understood that the upper and/or lower guiding grooves, particularly section of them, can be inclined or curved in any way desired, but have to be arranged together with the support rolls in such a manner that the rearward motion of the first bearing part 14, thus effected, will also result at the same time in a lifting motion of the closing disk 5. Embodiments are also possible wherein only one curved guiding groove 17 is provided on both sides for two support rolls. The curvature and the distance between the rear support rolls and the front support rolls have to be selected according to the pivoting movement desired.

In order to make the inclination of a first bearing part 14 guided by a guiding arrangement adjustable at any guiding position, two support rolls 18 having a common axis are adjustable transversely to their guiding grooves 17 of the first bearing part 14 and parallel to the center plane. In this way, it is possible to adjust the orientation of the first bearing part 14, and thus of the closing disk 5, for example in the range of the final pressing position in correspondence with the folded seam connection to be achieved; a linear or two-dimensional pressing being preferred depending on the respective problem. This adjusting facility can also be used for adjusting the distance between the pressing surfaces of the pressing wheel 4 and the closing disk. But orientation is also varied together with the distance. If, however, in the final pressing position, both a desired orientation and the distance should be adjustable independently from it, it is suitable to arrange both pairs of support rolls adjustable on the first bearing part 14. With two adjustable pairs of support rolls, the orientation of the closing disk can be adjusted within a given angular range for each distance of a range of distances. Since the correct selection of the distance is more important for many closing operations than the precise orientation of the closing disk, it will be sufficient, in most cases, if one pair of support rolls is adjustable.

In an adjustment device according to FIG. 3, it comprises a bearing block 19, on which support rolls 18 are rotatably mounted on either side, which may be displaced in an appropriate recess in the first bearing part 14 by means of an adjusting wheel 20. The adjusted position of the bearing block 19 can be fixed by a fixing element 21, particularly by arresting the adjusting wheel 20 by actuating the fixing element 21. In some cases, the adjustment device may comprise an elastic member, preferably a spring element, which renders the bearing block 19 able to be pressed into the first bearing part when high forces act on the closing disk in upward direction. In this way, the first bearing part 14 can carry out a small pivoting motion which is convenient in cases, such as when axial seams enter the folding region to be closed.

For moving the first bearing part 14, a first actuation element 22, preferably a hydraulic cylinder, is connected to the first bearing part 14 by a pivoting joint. The pivoting joint, comprises, for example, an eye piece 23 connected to the piston of the hydraulic cylinder, a bolt 24 of the first bearing part 14 being inserted through the eye of which. The first actuation element 22 may be fixed in an actuation position on the two-part guide blocks 16 and is displaceable in rearward direction, away from the pressing wheel 4 after releasing it from this position. To this end, the first actuation element 22 is guided in two displacement grooves 26, symmetric with respect to a center plane, preferably by two displacement rolls 25 on both sides of the actuation element 22 which are on a common axis. Due to the fact of being supported by only one pair of displacement rolls and due to the pivoting connection to the first bearing part 14, pivoting motion of the first bearing part 14 upon displacement involves a corresponding pivoting motion of the actuation element 22. In order to establish an actuation position, those ends of the displacement grooves 26 which face the pressing wheel are formed with a downwards leading section 26*a*. For fixing the first actuation element 22 to the guide blocks 16, the displacement rolls 25 are inserted into the section 26*a* and are held there by a securing element. A shear element not shown, e.g. in the form of a fixing screw, is screwed through threaded bores 27 above the displacement rolls 25 situated in the section 26*a*.

The guide blocks 16 are secured to a second bearing part 28 or can be considered to be part of it. The second bearing part 28 is displaceably supported in horizontal direction within a substantially horizontal straight-line motion mechanism or, the broad stand part 2*b*, only an edge 29 of a guiding recess being visible in FIG. 3. For actuating displacement, a second actuation element 30, preferably a hydraulic cylinder, is inserted between the stand part 2*b* of the machine and the bearing part 28, particularly together with a spring element 31. The second actuation element 30 renders the second bearing part 28 able to be advanced against the fixed wheel, and particularly also to be reset, in its straight-line motion mechanism. The spring element 31 may be formed as a Belleville spring washer, and is arranged in a force transmitting manner between a dog 32 and a piston part 33 of the second actuation element 30 at that side of the dog 32 connected to the second bearing part 28 which is averted from the pressing wheel 4. If upon working pipe segments a thickening, particularly a longitudinal seam, enters between the fixed wheel 3 and the pressing wheel 4, the spring element 31 enables movement of the pressing wheel 4 together with the second bearing part 28 away from the fixed wheel 3 and subsequently back again. In order to be able to draw the second bearing part 28 away from the fixed wheel 3 against the second actuation element 30, the piston part 33 has a closing portion 34 which engages the dog 32 at the side of the fixed wheel 3. For actuating the second actuation element 30 formed as a hydraulic cylinder, two hydraulic connections 30*a* are provided on it.

The cross-sectional view according to FIG. 3 shows preferred bearings of the fixed wheel 3 and the pressing wheel 4 as well of the closing disk 5. The bearing 5*a* of the closing disk is attached to the oblique surface of the first bearing part 14 by means of a screw 5*b*. The shaft 4*a* between the pressing wheel 4 and the pressing wheel drive 35 is rotatably mounted in the second bearing part 28 by a first and a second antifriction bearing 4*b*, 4*c*. The shaft 3*a* is rotatably mounted on the slim stand part 2*c* between the fixed wheel 3 and a universal joint 36 by a first and a second antifriction bearing 3*b*, 3*c*. A drive shaft 37 extends from the universal joint 36 further to a fixed wheel drive not shown in the drawing. The drive of either the pressing wheel and/or the fixed wheel is preferably formed as a hydraulic motor. In case two hydraulic motors are used, they may preferably be driven in series by a common pump and the driving speed is adjustable by a flow regulator. In order to ensure that the hydraulic motors operated in series result in substantially equal peripheral speeds at the fixed wheel 3 and the pressing wheel 4, the volumes of the motors are preferably adapted to the different circumferential lengths of the two wheels 3, 4. Two arms 10*b* of the pipe holding device 10 are interconnected by a spring connection 10*c* and serve for flexibly holding contacting elements which guide laterally the lower part of a pipe bend being worked.

Figure 4:
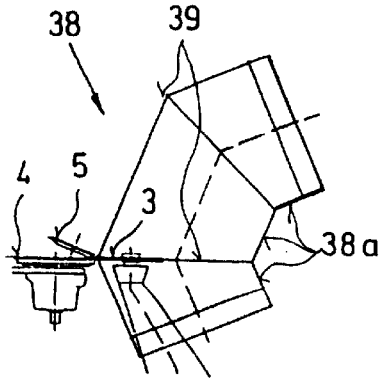
FIG. 4 is a schematic lateral view of a pipe bend during working.

FIG. 4 shows schematically a pipe bend 38 having three segments 38*a* interconnected by folded seam connections 39. For closing the folded seam connection, cooperation of the fixed wheel 3, being in the pipe bend 38, with the pressing wheel 4 and the closing disk 5 is needed.

Figure 5:
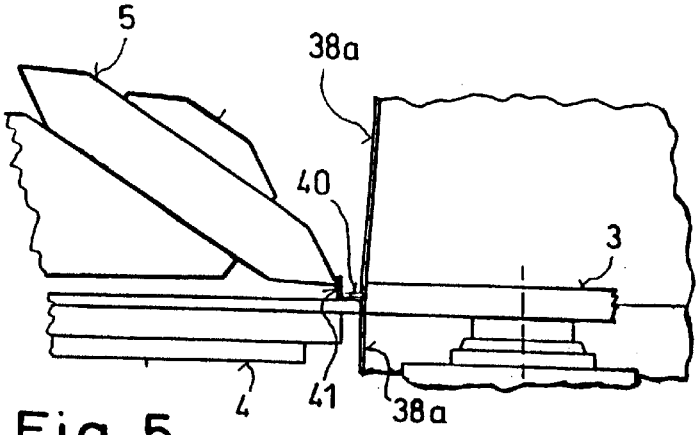
FIG. 5 a detail of FIG. 4.

The detail according to FIG. 5 shows how the upstanding edge of a double border 41 of the lower pipe segment 38a can be beaded around a single border 40 of the upper pipe segment 38*a* by the closing disk 5 due to its pivoting advance and can be pressed against the pressing wheel 4.

It has to be understood that the guiding arrangement between the first and second bearing part 14, 28 is not limited to such an arrangement where guide grooves 17 are formed on the second bearing part 28 and the guide blocks 16 connected to them. Embodiments are also possible wherein support rolls are on the second bearing part, while guiding grooves are on the first one. Instead of a combination of grooves and rolls, a combination of webs and rolls running on both sides of the webs are conceivable. The mirror symmetrical arrangement of pairs of grooves and rolls is also not necessary in each case, because one-sided guides could be formed in a sufficiently stable manner. In addition, the first bearing part 14 could be guided on the machine frame. In principle, any guiding device known to those skilled in the art and capable of guiding a pivoting advance of the closing wheel could be used.

What is claimed is:

1. A folding machine for producing folded seam connections between partial surfaces of a flat material forming at least a segment of a pipe, the folding machine comprising a machine stand;

a first wheel rotatably supported on said machine;

supporting and guiding means on said machine stand for carrying out a guided movement towards and away from said first wheel;

a second wheel displaceably supported on said supporting and guiding means to be displaced towards and away from said first wheel from an inoperative position into an operative position in which it engages a partial surface of said flat material and holds it against said first wheel;

bearing means movably guided on said folding machine;

a closing disk rotatably supported on said bearing means to be moved towards and away from said second wheel by said bearing means from a release position to a pressing position and vice-versa, said closing disk having a marginal region about its circumference for engaging a partial seam surface of said flat material and to close the connection;

a pivotal guiding arrangement for said bearing means and said closing disk to guide said closing disk from said release position to said pressing position and vice-versa by a pivoting motion combined with a linear displacement relative to said supporting and guiding means, said marginal region of said closing disk in the release position being remote from said second wheel thus enabling access to said second wheel, while being close to said second wheel in said pressing position.

2. Folding machine as claimed in claim 1, wherein said guiding arrangement comprises at least two guiding grooves inclined to each other, said bearing means being guided by said at least two guiding grooves.

3. Folding machine as claimed in claim 1, wherein said pivotal guiding arrangement for said bearing means and said closing disk is secured to said supporting and guiding means for said second wheel.

4. Folding machine as claimed in claim 3, wherein said guiding arrangement comprises at least two pairs of guiding grooves provided on said supporting and guiding means, each pair being arranged on one side of a center plane so as to be mirror symmetrical with respect to the center plane, and said bearing means comprise at least two pairs of support elements each engaging one of said guiding grooves substantially free from play in transverse direction to the respective groove.

5. Folding machine as claimed in claim 4, wherein said center plane is vertical.

6. Folding machine as claimed in claim 4, wherein said support elements comprise support rolls.

7. Folding machine as claimed in claim 4, further comprising adjusting means for at least part of said support elements for adjusting their position on said bearing means.

8. Folding machine as claimed in claim 7, wherein said adjusting means are formed so as to adjust position of the respective support element in transverse direction to its guiding groove and parallel to said center plane so as to adjust the position of said closing disk.

9. Folding machine as claimed in claim 1, wherein said bearing means comprises a single bearing for rotatably supporting said closing disk at one side thereof.

10. Folding machine as claimed in claim 1, further comprising first actuation means for moving said bearing means, while being guided by said pivotal guiding arrangement.

11. Folding machine as claimed in claim 10, wherein said first actuation means comprise a hydraulic cylinder.

12. Folding machine as claimed in claim 10, wherein said first actuation means is displaceable, the folding machine further comprising fixing means for securing said first actuation means in an operative position.

13. Folding machine as claimed in claim 12, further comprising displacement guiding means for said first actuation means, said displacement guiding means comprising at least two displacement grooves opposite to one another with respect to a center plane and at least two displacement rolls on a common axis each engaging one of said displacement grooves.

14. Folding machine as claimed in claim 12, further comprising pivoting connection means for interconnecting said first actuation means and said bearing means.

15. Folding machine as claimed in claim 1, further comprising second actuation means interconnected with said supporting and guiding means for moving said supporting and guiding means together with said second wheel.

16. Folding machine as claimed in claim 15, wherein said second actuation means is elastic.

17. Folding machine as claimed in claim 16, wherein said second actuation means comprises spring means interposed between itself and said supporting and guiding means.

18. Folding machine as claimed in claim 15, further comprising a knee-actuable valve switch for energizing said second actuation means.

19. Folding machine as claimed in claim 15, wherein said second actuation means comprise a hydraulic cylinder.

20. Folding machine as claimed in claim 1, wherein said supporting and guiding means comprises a straight-line motion guiding mechanism leading towards said first wheel.

21. Folding machine as claimed in claim 1, further comprising at least one drive means for at least one of said wheels, and speed varying means for said drive means.

22. Folding machine as claimed in claim 1, wherein said machine stand comprises a slim stand portion supporting said first wheel, a broad portion supporting both said supporting and guiding means and said bearing means, and a table surface displaceably supported by said broad portion so as to be displaced towards said first wheel.

23. Folding machine as claimed in claim 22, wherein said table surface is supported by a vertical axle on said broad portion.

24. Folding machine as claimed in claim 22, wherein said table surface is bipartite, a substantially horizontal pivoting axle being in-between.

* * * * *